US005185905A

United States Patent [19]

Küppers et al.

[11] Patent Number: 5,185,905

[45] Date of Patent: Feb. 16, 1993

[54] FIBER PROCESSING ROLL HAVING A HELICAL SAWTOOTH CLOTHING

[75] Inventors: Wilhelm Küppers; Hermann Trützschler, both of Mönchengladbach, Fed. Rep. of Germany

[73] Assignee: Trützschler GmbH & Co. KG, Mönchengladbach, Fed. Rep. of Germany

[21] Appl. No.: 714,845

[22] Filed: Jun. 13, 1991

[30] Foreign Application Priority Data

Jun. 15, 1990 [DE] Fed. Rep. of Germany ..... 4019151

[51] Int. Cl.[5] ..... D01G 15/84

[52] U.S. Cl. ..... 19/114; 29/895.211

[58] Field of Search ..... 19/112, 114; 29/121.4, 29/127, 128, 895.211; 140/97

[56] References Cited

U.S. PATENT DOCUMENTS

| | | | |
|---|---|---|---|
| 4,270,254 | 6/1981 | Berglöff et al. | 29/127 |
| 4,301,572 | 11/1981 | Miyamoto | 19/112 |
| 4,862,688 | 9/1989 | Schmolke | 19/112 |
| 5,008,979 | 4/1991 | Palm et al. | 19/114 |

FOREIGN PATENT DOCUMENTS

| | | | |
|---|---|---|---|
| 2221591 | 11/1972 | Fed. Rep. of Germany . | |
| 2263904 | 7/1973 | Fed. Rep. of Germany . | |
| 2539089 | 3/1977 | Fed. Rep. of Germany | 19/114 |
| 7915047 | 5/1979 | Fed. Rep. of Germany . | |
| 1533213 | 6/1968 | France . | |
| 59-94623 | 5/1984 | Japan | 19/114 |
| 746256 | 3/1956 | United Kingdom . | |
| 2013741 | 8/1979 | United Kingdom . | |

*Primary Examiner*—Peter Nerbun
*Assistant Examiner*—Michael A. Neas
*Attorney, Agent, or Firm*—Spencer, Frank & Schneider

[57] ABSTRACT

A fiber processing roll includes a groove provided in a roll surface helically about a longitudinal roll axis. The groove has at least one side wall which is inclined to a radius of the roll that extends to the inclined side wall. The groove has a top opening and a bottom; and the top opening has a width measured parallel to the axis and being greater than the width of the bottom. The fiber processing roll further has a sawtooth wire extending helically about the axis and forming a clothing on the roll. The sawtooth wire has a base rib received in the groove. The base rib has side walls and a bottom end face. One of the side walls of the base rib is inclined to the roll radius. The width of the base rib measured parallel to the axis decreases toward and is the smallest at the bottom end face of the base rib.

3 Claims, 2 Drawing Sheets

FIG. 2
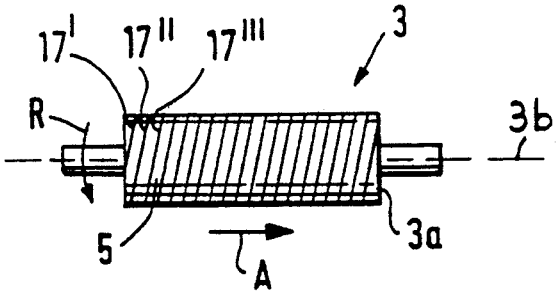
FIG. 3
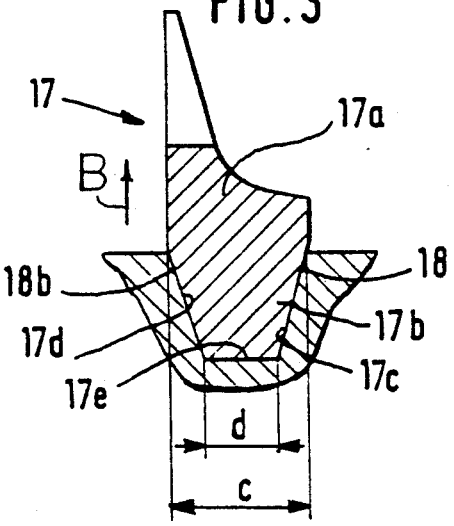
FIG. 4
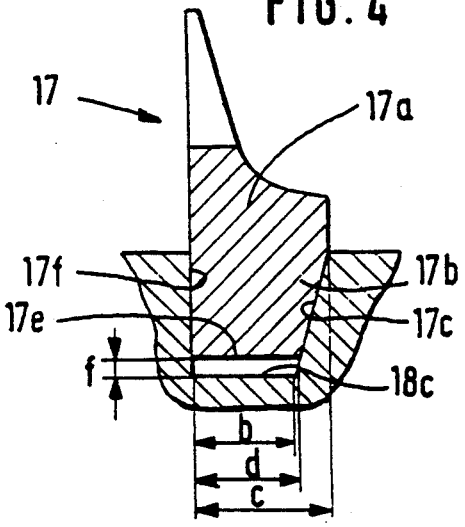
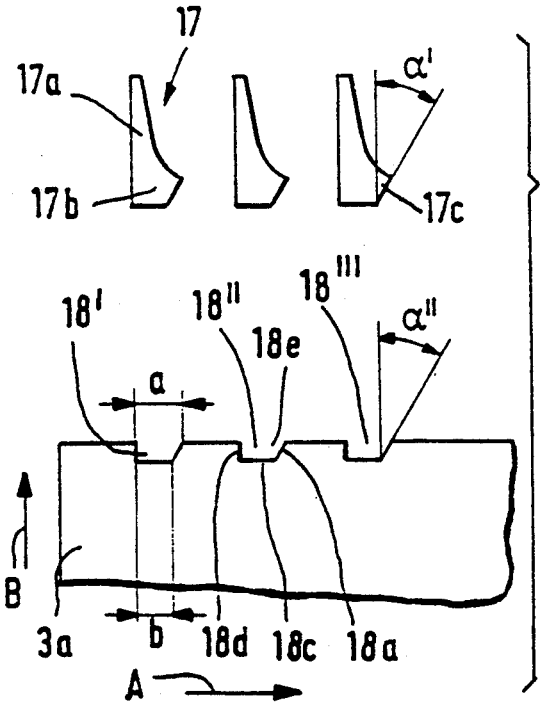
FIG.5a
FIG.5b
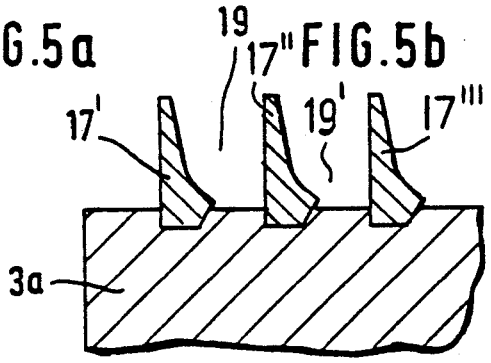

FIBER PROCESSING ROLL HAVING A HELICAL SAWTOOTH CLOTHING

CROSS REFERENCE TO RELATED APPLICATION

This application claims the priority of German Application No. P 40 19 151.6 filed Jun. 15, 1990, which is incorporated herein by reference.

BACKGROUND OF THE INVENTION

This invention relates to a clothed fiber processing roll which has on its surface a helically extending sawtooth wire provided with a base rib seated in a premachined helical groove of the roll, such as the licker-in of a carding machine.

In a known sawtooth roll of the above-outlined type the sawtooth clothing extends along the entire axial length of the roll in a single or multiple helix. The clothing wires are inserted into grooves that are premachined into the surface of the roll. The pitch of the clothing wires is determined by the disposition of the grooves and the number of the wires. In such a construction an intermediate helical space is obtained between adjoining turns. Conventionally, the grooves have an upwardly open, rectangular cross section, and the clothing wire has a base rib which too, is of rectangular cross section. During the mounting operation the base rib of the clothing wire is inserted into the groove and thereafter a wheel or similar structure is introduced into the channel-like intermediate spaces between adjoining clothing wires. The wheel laterally exerts a pressure on the roll surface (that is, on the roll webs defined between axially adjoining grooves or groove turns), whereby the webs are laterally pressed against the inserted base rib, resulting in an immobilization of the clothing wire in the groove.

It is a disadvantage of the prior art constructions as outlined above that the provision of grooves into the roll face is technologically complex. It is further a disadvantage that the groove cutting tool has to penetrate into the grooves slowly along the entire width of the roll which adversely affects a removal of chips. For this reason the cutting tool flares towards its end which, in turn, results in a narrow tool neck prone to breakage. It is a further disadvantage that the grooves have to be "rolled shut" for immobilizing the base rib of the clothing wire, resulting in a significant deformation of the cylinder surface. In case of a wire replacement, before a new clothing wire can be inserted into the rectangular groove, the groove has to be reopened (re-cut) which is time-consuming and involves further removal of material. Repeated material removal renders the roll useless.

SUMMARY OF THE INVENTION

It is an object of the invention to provide an improved fiber processing clothed roll of the above-outlined type from which the discussed disadvantages are eliminated and which, in particular, can be assembled in a simplified manner and which has a longer service life.

This object and others to become apparent as the specification progresses, are accomplished by the invention, according to which, briefly stated, the fiber processing roll includes a groove provided in a roll surface helically about a longitudinal roll axis. The groove has at least one side wall which is inclined to a radius of the roll that extends to the inclined side wall. The groove has a top opening and a bottom; and the top opening has a width measured parallel to the axis and being greater than the width of the bottom. The fiber processing roll further has a sawtooth wire extending helically about the axis and forming a clothing on the roll. The sawtooth wire has a base rib received in the groove. The base rib has side walls and a bottom end face. At least one of the side walls of the base rib is inclined to the roll radius. The width of the base rib measured parallel to the axis decreases toward and is the smallest at the bottom end face of the base rib.

The provision of the inclined surfaces of the grooves of the roll and the base ribs of the clothing wire result in significant improvements in the manufacture of the roll and the installation of the clothing wire on the roll. For cutting the grooves into the cylindrical roll surface a turning tool is used which tapers towards its end which significantly reinforces the tool bit thus protecting it against breakage. Further, the grooves may be cut with significantly higher speed than it has been possible heretofore. In contrast to known fiber processing rolls, an additional pressing against the roll webs between the grooves during installation can be dispensed with; the grooves are closed by themselves by virtue of the oblique surfaces. Since during a replacement of the clothing the groove does not have to be reshaped (since no deformation has taken place), a significantly simpler and more rapid installation of higher quality is possible and also, the service life of the carding cylinder is increased.

The invention is further directed to a clothing wire proper for installation in helical grooves pre-machined into the cylindrical surface of the fiber processing rolls. The clothing wire has a base rib for insertion into a roll groove. The base rib has at least one lateral inclined surface and the width of the base rib measured in a direction parallel to the material thickness of the base rib tapers towards and is the smallest at a free terminus of the base rib.

BRIEF DESCRIPTION OF THE DRAWING

FIG. 2 is a schematic view of the licker-in of the carding machine.

FIG. 3 is a sectional view of a preferred embodiment of the invention.

FIG. 4 is a sectional view of another preferred embodiment of the invention.

FIG. 5*a* is a fragmentary exploded side elevational view of a carding roll and a sawtooth wire according to a further preferred embodiment.

FIG. 5*b* is a sectional view of the construction of FIG. 5*a*, illustrated in an assembled state.

DESCRIPTION OF THE PREFERRED EMBODIMENTS

Figure 1:
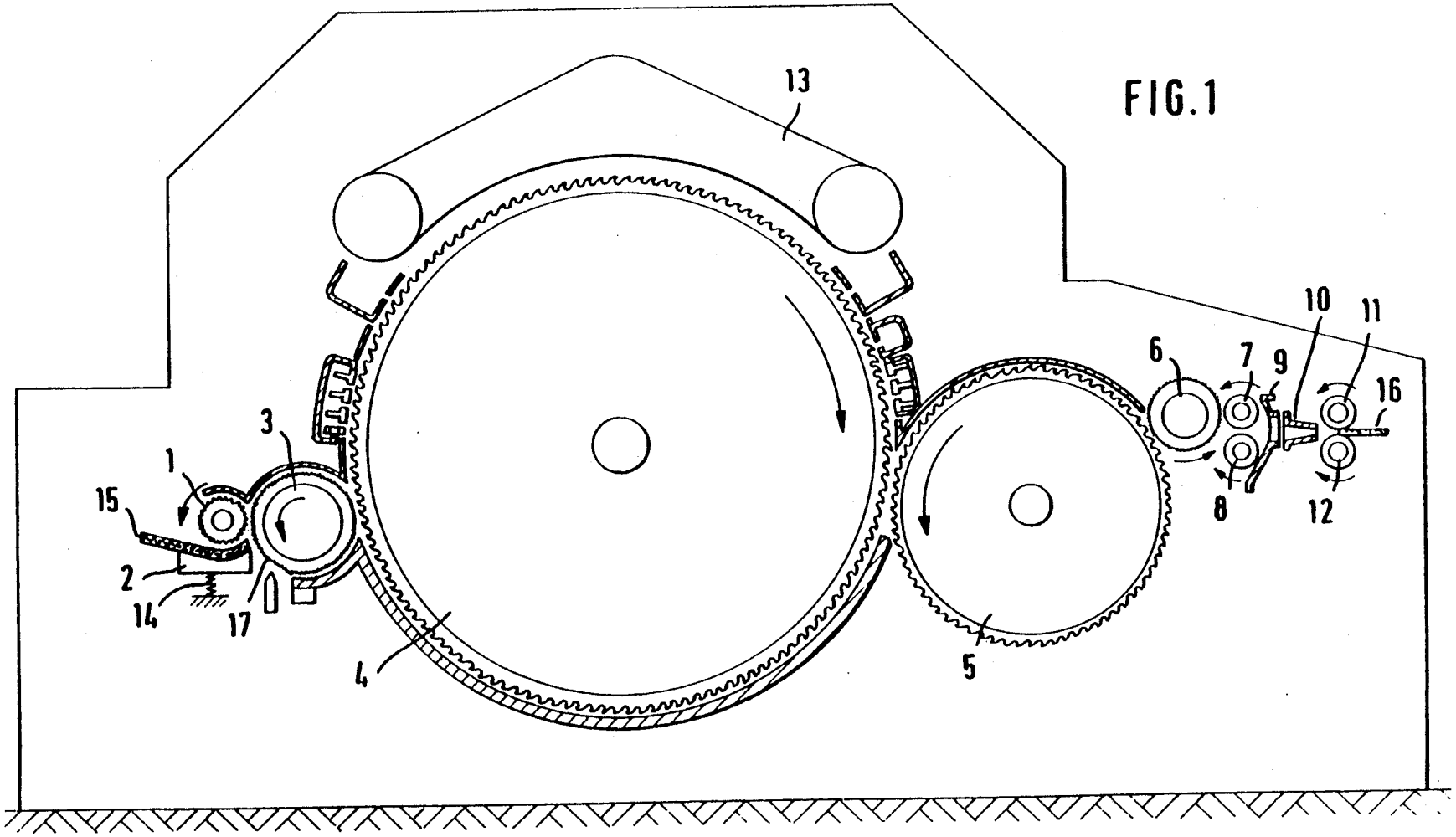
FIG. 1 is a schematic side elevational view of a carding machine incorporating the invention.

FIG. 1 shows a carding machine which may be, for example, an EXACTACARD DK 740 model, manufactured by Trützschler GmbH & Co. KG, Mönchengladbach, Germany. The carding machine has a feed roll 1 cooperating with a feed table 2, a licker-in 3, a main carding cylinder 4, a doffer 5, crushing rolls 7, 8, a web guiding element 9, a sliver trumpet 10, calender rolls 11 and 12 and revolving flats 13. The feed table 2 is pressed against the feed roll 1 by a spring 14. The fiber lap situated between the feed roll 1 and the feed table 2 is designated at 15, while the sliver discharged by the calender rolls 11, 12 is designated at 16. The licker-in 3 has a clothing 17 made of sawtooth wire and structured according to the invention as will be discussed below.

Turning to FIGS. 2, 5*a* and 5*b*, the licker-in 3 shown therein carries three side-by-side arranged carding wires 17', 17'' and 17''' mounted on the cylindrical body 3*a* of the licker-in 3. The clothing wires 17', 17'' and 17''' are, as shown in FIG. 5*a*, inserted into premachined roll grooves 18', 18'' and 18''', respectively. The carding wires 17', 17'' and 17''' extend parallel to one another in a helical course about the licker-in axis 3*b*, along the length of the licker-in 3. In the illustrated embodiment shown in FIG. 2, the course of the helices 17', 17'' and 17''' are left-handed relative to the direction of rotation R of the licker-in 3. As seen particularly in FIG. 5*b*, between adjoining clothing wires 17', 17'' and 17''' channel-like intermediate spaces 19 and 19' are provided.

Turning to FIG. 3, the clothing wire 17 has a tooth height 17*a* above the roll surface as well as a base rib 17*b* which has a trapezoidal cross section including two lateral faces 17*c* and 17*d* which are inclined with respect to a roll radius B drawn to those lateral faces. Or, stated differently, the lateral faces 17*c* and 17*d* are inclined at an angle other than 90° to the roll surface. The base rib 17*b* has a planar bottom end face 17*e*. The angle which is formed by the inclined surface 17*d* and the radius B of the licker-in 3 has the same magnitude as the angle which is formed by the inclined surface 17*c* and the licker-in radius B. The base rib 17*b* is received in a groove 18 of trapezoidal two inclined side walls 18*a* and 18*b* that are in face-to-face engagement with the respective side walls 17*c*, 17*d* of the base rib 17*b*. The width c of the base rib 17*b* (measured in a direction perpendicular to the wire length) thus tapers towards the end face 17*e* where it has a width d which is the smallest width dimension of the base rib 17*b*.

FIG. 4 illustrates an embodiment where the base rib 17*b* has only a single inclined surface 17*c* while the oppositely located surface 17*f* of the base rib 17*b* is at a right angle with respect to the cylinder surface of the licker-in 3. The base rib 17*b* thus has a sawtooth profile. Between the groove bottom 18*c* and the bottom end face 17*e* of the base rib 17*b* a clearance f is defined.

In the embodiment shown in FIGS. 5*a* and 5*b*, each groove 18', 18'' and 18''' has a lateral inclined surface 18*a*, a lateral surface 18*d* which is perpendicular to the cylinder surface of the body 3*a* and a bottom face 18*c*. As viewed in the axial direction indicated by the arrow A, the width a of the groove entrance 18*e* is greater than the width b of the groove bottom 18*c*. The angle $\alpha'$ which is defined by the inclined surface 17*c* of the base rib 17*b* and the radius B of the licker-in 3 is equal to the angle $\alpha''$ formed by the inclined surface 18*a* of the groove 18 and the radius B.

It will be understood that the above description of the present invention is susceptible to various modifications, changes and adaptations, and the same are intended to be comprehended within the meaning and range of equivalents of the appended claims.

What is claimed is:

1. A fiber processing roll comprising (a) a groove provided in a roll surface helically about a longitudinal roll axis; said groove being defined by a first side wall forming a zero angle with a radius of the roll extending to said first side wall and a second side wall being inclined to said radius; said groove having a top opening and a bottom; said top opening and said bottom having a width measured parallel to said axis; the width of said opening being greater than the width of said bottom; and (b) a sawtooth wire extending helically about said axis and forming a clothing on the roll; said sawtooth wire having a base rib received in said groove; said base rib having first and second side walls and a planar bottom end face; said first side wall of said base rib being at a zero angle to said roll radius and said second side wall of said base rib being inclined to said roll radius; a width of said base rib measured parallel to said axis decreasing toward and being the smallest at said bottom end face of said base rib; said base rib complementally fitting in said groove in a face-to-face engagement with respective side walls of said groove.

2. A fiber processing roll as defined in claim 1, in combination with a carding machine including a licker-in; said fiber processing roll constituting said licker-in.

3. A fiber processing roll as defined in claim 1, wherein the bottom end face of said base rib is at a clearance from the bottom of said groove.

* * * * *